United States Patent [19]

Moser et al.

[11] Patent Number: 4,964,262

[45] Date of Patent: Oct. 23, 1990

[54] MACHINE FOR FILLING AND CLOSING TWO-PIECE CAPSULES

[75] Inventors: Theodor Moser, Steinenberg; Eberhard Krieger, Weinstadt, both of Fed. Rep. of Germany

[73] Assignee: Robert Bosch GmbH, Stuttgart, Fed. Rep. of Germany

[21] Appl. No.: 392,339

[22] Filed: Aug. 11, 1989

[30] Foreign Application Priority Data

Sep. 3, 1988 [DE] Fed. Rep. of Germany ..... 3830013

[51] Int. Cl.[5] ..... B65B 57/06; B65B 43/42

[52] U.S. Cl. ..... 53/506; 53/53; 53/900

[58] Field of Search ..... 53/53, 109, 281, 282, 53/381 A, 505, 506, 900, 468, 471

[56] References Cited

U.S. PATENT DOCUMENTS

| | | | |
|---|---|---|---|
| 3,070,932 | 1/1963 | Höfliger | 53/281 |
| 3,527,015 | 9/1970 | Aronson et al. | 53/282 |
| 3,978,640 | 9/1976 | Crossley et al. | 53/282 X |
| 4,615,165 | 10/1986 | Gamberini | 53/282 X |
| 4,731,979 | 3/1988 | Yamamoto et al. | 53/281 X |

FOREIGN PATENT DOCUMENTS 1117471 11/1961 Fed. Rep. of Germany .

*Primary Examiner*—Robert L. Spruill
*Assistant Examiner*—Linda B. Johnson
*Attorney, Agent, or Firm*—Edwin E. Greigg

[57] ABSTRACT

A capsule filling and capping machine including a testing apparatus for ascertaining the presence of capsule pieces (bottom and cap) in the conveyor apparatus. The conveyor apparatus includes receptacles into which the capsules are tightly inserted. A test head, with chambers disposed in it that communicate with a source of negative pressure or overpressure, respectively, via a throttle is brought into contact with the receptacles, and the pressure of the chambers is monitored by pressure sensors. The output of piezorestrictive pressure sensors is evaluated electronically and processed further into signals to prevent capsules from being filled, to reject defective capsules, or to stop the machine if there is a problem related to one of the capsules.

8 Claims, 2 Drawing Sheets

MACHINE FOR FILLING AND CLOSING TWO-PIECE CAPSULES

BACKGROUND OF THE INVENTION

The invention is based on a machine for filling and closing two-piece capsules as generically defined hereinafter. In a machine of this type known from German Auslegeschrift No. 11 17 471, the telescopingly joined bottoms and caps of the capsules are separated and transported with the caps in receptacles of a first conveyor wheel and the bottoms in receptacles of a second conveyor wheel. They are transported first to a monitoring apparatus, then to a filling apparatus and finally to a closing apparatus, where the caps are put onto the bottoms of the capsules. In the monitoring apparatus, the presence of the bottoms in the receptacles is checked by subjecting the receptacles placed to coincide with chambers in a test head below the conveyor wheel to negative pressure. If a capsule bottom is missing in any receptacle, then normal pressure prevails in the test head during the test period because of the ambient air flowing through the unoccupied receptacle, so that an electrical contact in an electrical control line drops, causing the machine to shut down. In this machine, purposeful scanning to find out which one of the predetermined number of receptacles on a conveyor wheel is unoccupied cannot be done.

OBJECT AND SUMMARY OF THE INVENTION

The machine according to the invention has an advantage over the prior art that the presence or absence of one piece of a capsule can be ascertained with respect to each of the individual receptacles, and from the associated signal a further handling step, such as filling and the like, can be prevented and in its stead, an early, controlled rejection can be effected. Holes and deformities in the capsule pieces can also be detected with the apparatus according to the invention.

The invention will be better understood and further objects and advantages thereof will become more apparent from the ensuing detailed description of a preferred embodiment, taken in conjunction with the drawings.

DESCRIPTION OF THE PREFERRED EMBODIMENT

Figure 1:
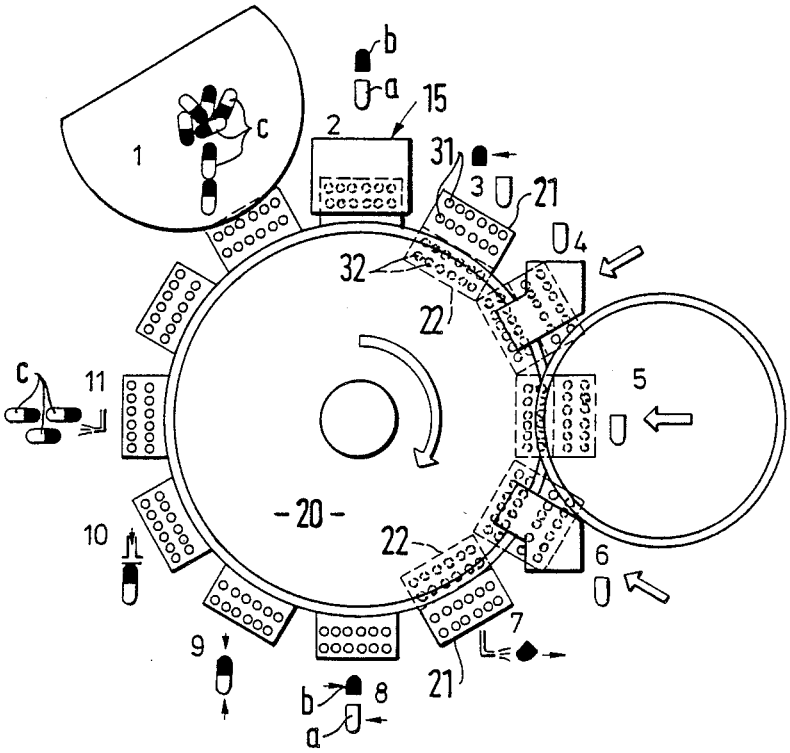
FIG. 1 is a simplified plan view of a capsule filling and closing machine.

The machine for filling and closing capsules c made up of a capsule bottom a and a cap b fitting onto it has a 12-part conveyor wheel 20 and 12 stations. The conveyor wheel is rotated in increments about a vertical axis and at the 12 stations 1–12 of which the various handling apparatuses are disposed along the path of rotation. At station 1, the empty capsules c to be filled enter in random order and are then aligned and delivered to the conveyor wheel 20 in order. Next, the caps b are separated from the bottoms a, and both are tested at station 2 by a testing apparatus 15 as to their presence and intactness. At station 3, the caps b do not coincide with the bottoms a, so that at stations 4, 5 and 6 the capsule bottoms a can be filled with the intended product. At station 7, any bottoms a and caps b that are detected as being defective are rejected. At station 8, the caps b are moved back to coincide with the bottoms a, and at stations 9 and 10 they are joined to the capsule bottoms a. At station 11, the correctly filled and closed capsules c are expelled and carried away. Finally, at station 12, the receptacles of the conveyor wheel 20 are cleaned before being filled with empty capsules again at station 1.

Twelve holders 21 for capsule bottoms a are secured at equal angular intervals on the circumference of the conveyor wheel 20 that is incrementally rotated about a vertical axis. Above the holders 21, other holders 22 for the caps b are also disposed on the conveyor wheel 20, these being both raisable and lowerable and radially displaceable, so that in a first position, these holders 22 coincide with and are in contact with the lower holders 21; in a second position, they are above and spaced apart from the holders 21 (FIG. 2); and in a third position, they are located above and radially inward from the holders 21. These positions are controlled by a stationary cam plate 24 having a cam groove 25 and a cam ring 26, via radially displaceable carriages 27 and vertically displaceable hoisting elements 28, to which the upper holders 22 are secured.

The lower holders 21 have vertically aligned receptacles 31 for the capsule bottoms a, and the upper holders 22 likewise have vertically aligned receptacles 32 for the caps b. The receptacles 31 and 32 are for instance arranged in two rows of six each, coinciding exactly in the holders 21, 22. Like the capsule bottoms a and caps b, they are cylindrical in shape, and are adapted to the bottoms and caps in such a way that the bottoms a and b can slide in them, yet with their slightly conical shape they surround them tightly at the circumference. In their lower part, at the transition to an opening 33, the receptacles 31 in the lower holders 21 have a conical step 34, at which the capsule bottoms a are supported on their rounded end. At the transition to an opening 35, the upper receptacles 32 likewise have a step 36, on which the caps b are supported with the rim around their opening. The opening 35 in the receptacles 32 in the upper holder 22 has a width such that the capsule bottoms a can slide through it. At station 1, the empty capsules c are inserted in the assembled state into the receptacles 31, 32 of the holders 21, 22, with the upper holder 22 resting on the lower holder 21, and the receptacles 31, 32 in alignment with one another. The capsule bottoms a, the outside diameter of which is smaller than that of the caps b, can then slide through the openings 35 in the upper holder 22 into the receptacles 31 in the lower holder 21, while the rims at the opening of the caps b are seated on the steps 34. By an ensuing vertical motion upward of the upper holder 22, while the receptacles 31 in the lower holder 21 are subjected to negative pressure through the openings 33, the caps b are pulled off the bottoms a, and the bottoms a are aspirated into the receptacles 31, until their rounded ends are seated on the steps 34 of the receptacles 31.

Figure 2:
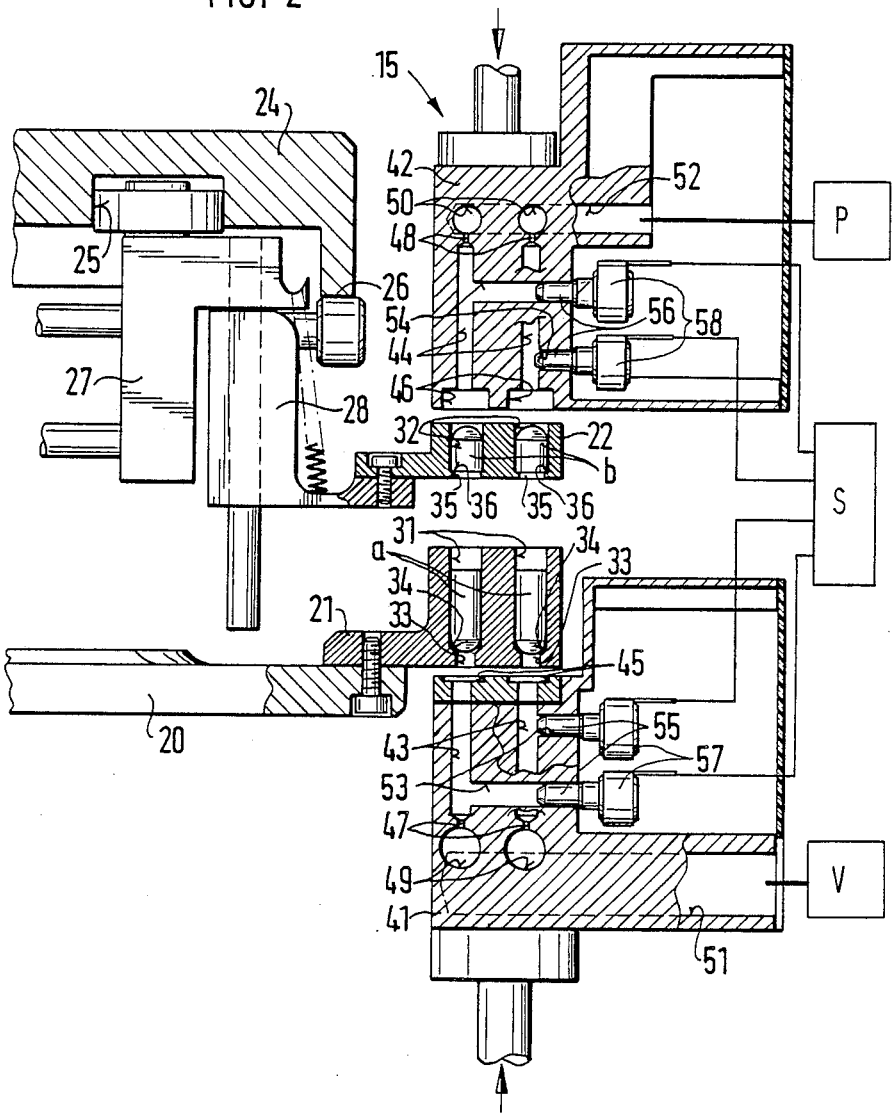
FIG. 2 is a cross-sectional view of a capsule testing apparatus in the machine according to FIG. 1.

To test for the presence of capsule bottoms a in the receptacles 31 of the lower holders 21 and of caps b in the receptacles 32 of the upper holders 22, and to test for the absence of damage in the capsule pieces in terms of holes and deformities, the capsule bottoms a and caps b are separated from one another; to this end, the upper holder 22 in station 2 is in an upper position, in which it has been raised above the lower holder 21 (see FIG. 2). The testing apparatus 15 associated with station 2 has two test heads 41, 42, a lower one 41 for testing the bottoms a and an upper one 42 for testing the caps b. During the stopped phase of the conveyor wheel 20, the two test heads 41, 42 are movable by a vertical motion into contact with the holders 21, 22 located at station 2; specifically, the lower test head 41 contacts the underside of the holder 21, and the upper test head 42 contacts the top of the upper carrier 22. Located in both test heads 41, 42 are respective vertical blind bores 43, 44, which are disposed in the same pattern as the receptacles 31, 32 in the holders 21, 22, so that in station 2 they coincide with them. On their ends contacting the holders 21, 22, the bores have wider portions 45, 46, the diameter of which is larger than the ends oriented toward them of the openings 33 in the lower holder 21, and of the receptacles 32 in the upper holder 22, respectively. The blind bores 43, 44 each discharge via a respective narrowed bore functioning as a throttle 47, 48 into transversely extending conduits 49, 50, which communicate with a connecting conduit 51, 52. The connecting conduit 51 in the lower test head 41 communicates with a negative pressure source, not shown, and the connecting conduits 52 in the upper test head 42 communicates with a source of compressed air. In the test heads 41, 42, each blind bore 43, 44 moreover communicates with a respective transverse bore 53, 54, into the opening of which the head 55, 56 of respective pressure sensors 57, 58 is tightly inserted. The test heads 41 and 42, each have as many pressure sensors 57 and 58 as there are receptacles in order to determine a test for each receptacle.

The pressure sensors 57, 58 are preferably of the piezorestrictive type, which vary their electrical resistance or output as a function of changes in pressure. Each of the pressure sensors 57, 58 is connected to an electrical evaluation circuit, which by a predetermined output value of the particular pressure sensor at a predetermined test instant detects the presence or absence and intactness or damage of a capsule bottom a or cap b and reports it as necessary to a defect indicator, rejection device, shutoff device and the like, one for each receptacle and pressure sensor.

The testing apparatus 15 functions as follows: As soon as a pair of holders 21, 22 has entered the testing station 2, the lower test head 41 is raised up to meet the underside of the lower holder 21 and the upper test head 42 is lowered onto the top of the upper holder 22, so that they press tightly against them. If all the receptacles 31 of the lower holder 21 are occupied with capsule bottoms a, a negative pressure is generated by suction through the conduits 49, 51 into the chambers formed by the bores 43, transverse bores 55, openings 33 and enlarged portions 45, since the bottoms a block off the flow of air through the receptacles 31, so that the resistance or output of the pressure sensors 57 is varied to a predetermined extent. This value is sampled at a predetermined test instant. If one of the receptacles 31 is not occupied, or contains a capsule bottom a that has a hole or is deformed, then air can flow through the receptacle 31 into the chamber formed by the bores, so that a vacuum will not develop in that chamber. In that case, at the test instant either no change or only a slight change in the output of the pressure sensor 57 for that chamber will be ascertained. As a result of this finding, a signal for the applicable receptacle 31 is generated and further processed, to indicate the defect in the applicable receptacle and to reject the damaged capsule at station 7; if a defect is reported repeatedly for the same receptacle 31 of the holder 21, then a signal to check it or to stop the machine is generated.

Testing for the presence of caps b in the receptacles 32 of the upper holders 22 is carried out similarly to what is described above. With the upper test head 42 seated tightly on the upper holder 22, chambers that are formed by the receptacles 32, the bores 44 and the transverse bores 56 are closed tightly by the caps b in the receptacles 32. By supplying compressed air through the connecting conduit 52, the conduits 50 and the throttles 48, a pressure is built up in this chamber, as a result of which the resistance or the output of the associated pressure sensor is varied. This variation, which is sampled at the predetermined test instant, indicates that the receptacles 32 are occupied and the caps b located in them are intact. In the event of an unoccupied receptacle 32 or a damaged cap b in a receptacle 32, the compressed air entering in a limited amount through the throttle 48 flows out through the leaking recess 32, so that no pressure builds up upstream of the applicable pressure sensor 58. As a result, there is no change in output at the test instant for that particular receptacle. This characteristic is further processed, as described above for the receptacles 31 in the holder 21. If no changes in pressure are sensed at the test instant at the pressure sensors 57, 58 in the upper test head 42 and lower test head 41, which monitor the aligned pairs of receptacles 31, 32 in the upper and lower holders 21, 22, then the combination of their signals indicates that no capsule c has been delivered. If that signal combination occurs successively, then there is some bottleneck in the delivery, and the machine is shut off.

It is understood that the machine is automatic so that the capsules are placed in the machine at station 1 as each holder is positioned at station 1 and the capsules are tested, filled and capped at the intended station as the holders are moved from station-to-station.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A machine for filling and closing two-piece capsules, each capsule having a bottom and a cap, comprising a plurality of conveyor devices which are movable to different stations, circumferentially, each of aid conveyor devices including a plurality of first receptacles for receiving and supporting said capsule bottoms and a plurality of separate corresponding second receptacles for receiving and supporting said caps, said first and second receptacles surrounding said bottoms and caps, a testing apparatus for testing the presence of said bottoms and caps of said capsules in said first and second receptacles, said test apparatus including first and second test heads, each of said first and second test heads include a plurality of chambers that are movable into coincidence with said first and second receptacles, a first source of differential pressure that communicates with said first test head, a second source of differential pressure that communicates with said second test head, each receptacle of said plurality of first receptacles communicates via a throttle (47) with said first differential pressure source, each receptacle of said plurality of second receptacles communicates via a throttle (48) with said second differential pressure source, a separate pressure sensor that communicates with each receptacle of said pluralities of first and second receptacles, each pressure sensor (57, 58) produces an electrical output signal in accordance with a differential pressure applied thereto, and an electrical switching device that receives said output signals from each of said sensors and controls filling of said capsules.

2. A machine as defined by claim 1, in which said second differential pressure source is a compressed air source and said pressure sensors are of a type that emits an electrical output signal at a predetermined overpressure.

3. A machine as defined by claim 1, in which said first differential pressure source is a negative pressure source and said pressure sensors are of a type that emit an electrical output signal at a predetermined negative pressure.

4. A machine as defined by claim 1, in which said first and second test heads (41, 42) are movable toward said first and second plurality of receptacles respectively, into sealing contact therewith.

5. A machine as defined by claim 2, in which said first and second test heads (41, 42) are movable toward said first and second plurality of receptacles respectively, into sealing contact therewith.

6. A machine as defined by claim 3, in which said first and second test heads (41, 42) are movable toward said first and second plurality of receptacles respectively, into sealing contact therewith.

7. A machine as defined by claim 2, in which said first differential pressure source is a negative pressure source and said pressure sensors are of a type that emit an electrical output signal at a predetermined negative pressure.

8. A machine as defined by claim 7, in which said first and second test heads (41, 42) are movable toward said first and second plurality of receptacles respectively, into sealing contact therewith.

* * * * *